US005797226A

United States Patent [19]

MacKarvich

[11] Patent Number: 5,797,226

[45] Date of Patent: Aug. 25, 1998

[54] DRIVE ANCHOR FOR MANUFACTURED HOME

[76] Inventor: Charles J. MacKarvich, 1720 Tyler Green Trail, Atlanta, Ga. 30080

[21] Appl. No.: 766,066

[22] Filed: Dec. 16, 1996

[51] Int. Cl.[6] ..... E02D 5/74

[52] U.S. Cl. ..... 52/155; 52/DIG. 11; 248/508; 248/545

[58] Field of Search ..... 52/155, 165, 166, 52/158, DIG. 11, 292, 299, 23; 248/507, 508, 545, 547

[56] References Cited

U.S. PATENT DOCUMENTS

| | | | |
|---|---|---|---|
| 2,001,719 | 5/1935 | Greene | 52/158 |
| 3,747,288 | 7/1973 | Grimelli | 52/23 |
| 3,830,457 | 8/1974 | Stewart | 52/155 X |
| 3,845,597 | 11/1974 | Foster | 52/166 |
| 4,180,952 | 1/1980 | Vanderlyn | 52/166 X |
| 4,429,849 | 2/1984 | Maier | 52/155 X |

OTHER PUBLICATIONS

Cross Drive Rock Anchor MRA, Tie Down Engineering, 1 page.

*Primary Examiner*—Creighton Smith

*Attorney, Agent, or Firm*—Thomas, Kayden, Horstemeyer & Risley

[57] ABSTRACT

A drive anchor (10) for use with a stabilizing foundation system of a manufactured home mounted upon piers includes an elongated rectilinear, C-shaped in cross section support bracket (12) that defines sets of offset holes (20 and 26, 24 and 30, and 22 and 28) that receive drive rods (31, 32, 33) which are driven through the holes and into the ground. The anchor can be installed in all densities of soil, including rock, by driving the rods through and between the rocks.

12 Claims, 2 Drawing Sheets

DRIVE ANCHOR FOR MANUFACTURED HOME

FIELD OF THE INVENTION

The present invention relates generally to a tie down anchor for use in a stabilizing foundation system of a manufactured home. More specifically, the invention relates to a tie down anchor that includes a set of diverting rods driven into the soil and that can be used in all densities of soil, including rock.

BACKGROUND OF THE INVENTION

Manufactured homes, such as mobile homes, trailers, pre-made houses, and the like, are a common type of housing used in various parts of the United States. Because these homes are designed to be easily moved from one site to another, they usually are not placed on or secured to a permanent foundation, but rather are typically placed on piers such as concrete blocks or stabilizing jacks. If the home is not anchored securely in position, it can be shifted from its position on such blocks or jacks by strong winds or earth tremors. This can cause not only serious damage to the home itself but may also cause human injury. Another potential danger is the breakage of gas pipes and subsequent ignition of escaping gas.

Various types of stabilizing means have been used in the past, commonly including guy wires or straps tying the home to ground fixtures either permanently or temporarily inserted in the ground. For example, one commonly used ground fixture is an anchor that includes a helix or auger plate attached to an anchor shaft. The shaft is inserted, with the helix plate downwards, into the ground as far as it will go until the tensioning head at the top of the shaft is adjacent the ground. The shaft is usually positioned after the home is put into place and the shaft is typically inserted at an angle to extend it into the ground under the home. The upper end of the shaft has the tensioning head welded thereto to which the strap attaches. An anchor of this type is disclosed in U.S. Pat. No. 3,747,288 to Grimelii.

The above-described auger anchor is nearly impossible to insert into rock and so cannot be used if rock is present on top of or under the soil. Instead, a cross drive rock anchor is commonly used. This type of anchor includes an "X" shaped bracket formed of a set of tubes welded intermediate their ends to each other in an "X" shape, through which two rods are driven into the ground. A tensioning head is typically welded to the bracket at the juncture of the two tubes. In order for this type of anchor to be properly installed, there must be solid rock within one to five inches of the ground surface. If there is rock but it is too far under the surface, the rod tends to bend as it is driven into the ground. On the other hand, if the rod passes through shallow rock, it is stabilized and is able to be driven through rock that is further beneath the ground. This type of anchor also will not work on some types of soil, in particular low density soils, where, when pulled laterally, the upper shaft portion of the rod tends to slice through the soil. Therefore, a disadvantage of this anchor is that it is effective only when there is solid rock within one to five inches of the surface. In many areas, obviously, neither the auger type anchor or the cross drive rock anchor are suitable.

Several different embodiments of foundation stabilizing systems are disclosed in presently pending patent applications filed by Applicant, Ser. No. 08/629,834, filed Apr. 10, 1996, Ser. No. 08/644,069, filed May 9, 1996, and Ser. No. 08/739,717, filed Oct. 29, 1996. The disclosures of these applications are incorporated herein in their entireties, by reference. In general, these applications disclose stabilizing foundation systems for a manufactured home mounted upon parallel I-beams supported by rows of spaced piers. The piers are supported by stabilizer pads or cleated pads. The systems further include lateral stabilizer bars, or compression members, extending between and abutting the piers and their adjacent anchors, or between the piers themselves. The systems also include straps which tie the anchors to the manufactured home. The systems create a continuous foundation across the home and transfer wind forces across the home from the windward side to the leeward side.

SUMMARY OF THE INVENTION

Briefly described, the present invention is an anchor for use with manufactured homes that can be installed in soils of all density, including rock. Further, if the anchor is used where there is rock under the surface, the rock does not have to be located near the surface. The anchor includes an elongated C-shaped rod support bracket that is a C-shaped plate or channel beam having parallel first and second arms and a middle section extending between and connected to the arms. The bracket is arranged to lie on the ground with its first arm engaging the ground and its second arm suspended above the ground. The bracket includes three pairs or sets of holes located at intervals along the length of the bracket, two outer sets adjacent opposite ends of the bracket and a middle set intermediate its ends, with one hole of each set formed in the first arm at the ground and the other hole of each set formed at the juncture of the second arm and the connecting section and spaced above the ground. The outer sets of holes are arranged such that the holes at the juncture of the second arm and the connecting section are longitudinally offset along the length of the bracket from the holes in the first arm, with the holes in the first arm located to the outside of the holes at the juncture of the second arm and the connecting section.

During installation, the rod support bracket is placed so that the first arm of the bracket lies flat upon the ground, with the open face of the bracket directed toward the manufactured home. A drive rod is driven into the ground through each of the sets of holes. The rods extending through the outer sets of holes will divert downwardly away from each other and will also be driven in a direction toward the open face of the C-shaped bracket, toward the home. The rod extending through the central set of holes will be driven at a right angle relative to the length of the bracket but will also be driven in a direction toward the open face of the bracket. Each of the rods has an enlarged section located at its top portion which is of larger breadth than the holes in the support bracket so that the rods cannot be driven through the bracket.

The anchor as described above can be used in areas of low density soil with the three rods as described. Alternatively, the anchor can be used in areas of high density soil or rock with just the two outer rods installed. A tensioning head is fastened to the second arm of the rod support bracket for fastening a tensioning strap to the anchor.

The anchor can be used in combination with a manufactured home stabilizing foundation system such as disclosed in the patent applications previously filed by applicant.

Therefore, it is an object of the invention to provide a soil anchor that can be inserted into rock.

Another object of the invention is to provide a soil anchor that can be used when there is rock more than five inches below the ground surface.

A further object of the invention is to provide a soil anchor that can be used in soils of low to high density, including rock.

A still further object of the invention is to provide a soil anchor that can be used where there is rock below the surface and that can be used with a foundation stabilizer system including outer compression members.

Other objects, features, and advantages of the present invention will become apparent upon reading the following specification, when taken in conjunction with the accompanying drawings.

DETAILED DESCRIPTION OF A PREFERRED EMBODIMENT

Figure 1:
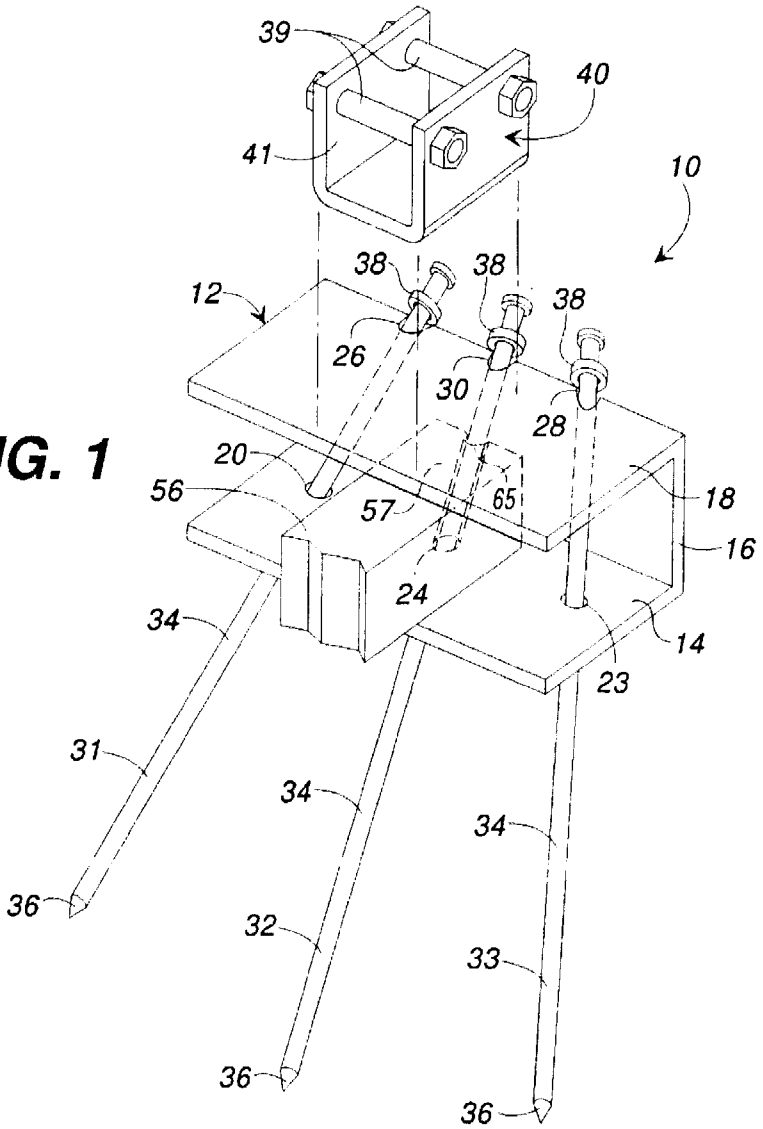
FIG. 1 s a perspective view of the soil anchor of the present invention with its tensioning head suspended above the support bracket.

Referring now in more detail to the drawings, in which like numerals indicate like parts throughout the several views, FIG. 1 shows a drive anchor 10 according to the present invention. Elongated, rectilinear, C-shaped in cross section rod support bracket 12 is essentially a C-shaped channel beam, having a first or lower arm 14, a connecting portion or web 16 extending at a right angle to the first arm, and a second or upper arm 18 which is parallel to the first arm and extends at a right angle to the connecting portion 16. The rod support bracket is manufactured of steel or some other rigid material.

Rod support bracket 12 includes means for receiving the shaft portion of drive rods. In the preferred embodiment, these means are sets of holes formed in the bracket. First arm 14 has three holes formed therein, two outer holes 20, 22 and a central hole 24 which is intermediate the outer holes. The outer holes are preferably elliptical in shape. Three more holes are placed at the juncture of the connecting portion 16 with the second arm 18. The two outer second holes 26, 28 are also elliptical in shape and are offset from and located inwardly on the support bracket of the two outer first holes. The second central hole 30 is not offset of the first central hole. Bracket 12 thus includes three pairs or sets of holes; 20 and 26, 24 and 30, and 22 and 28.

Drive rods 31, 32, and 33 are passed through each of the sets of holes. The drive rods each include an elongated shaft portion 34 having a pointed tip 36. An enlargement 38 near the upper end of the rod is large enough to keep the rod from being passed all the way through a hole and therefore functions as a mechanical stop.

Due to the offset placement of the second outer holes 26 and 28 and the first outer holes 20 and 22, the rods placed in the outer sets of holes will be driven divergently from each other and will be angled toward the open side of the bracket. The centrally placed rod will also be angled toward the open side of the bracket.

Figure 2:
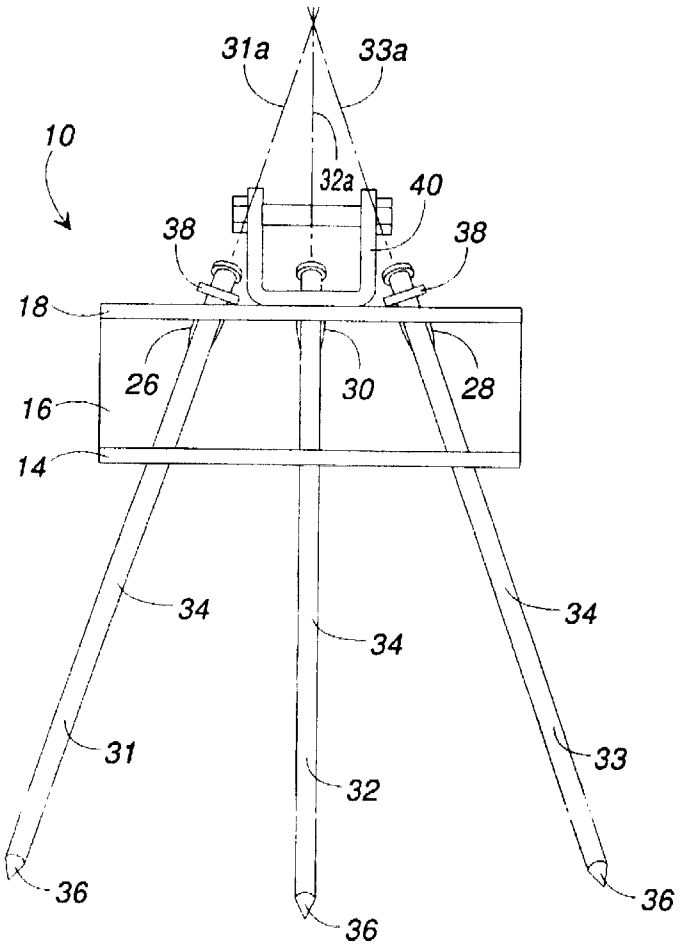
FIG. 2 is front view of a soil anchor of the present invention.

As shown in FIGS. 1 and 2, a tensioning head 40 is welded or otherwise fastened to the outer surface of the second arm 18 of the rod support bracket. The tensioning head is welded out of the way of the second central hole 30 so that the central rod 32 does not have to be driven through the tensioning head. Alternatively, the tensioning head may include a hole that mates with the second central hole of the bracket so that the central rod can be driven through the tensioning head as well. The tensioning head is the same type as those used with prior art auger and rock anchors, being a C-shaped plate 41 having opposed, aligned holes for accepting one or two carriage bolts 39 for holding an end of a tie strap.

Figure 3:
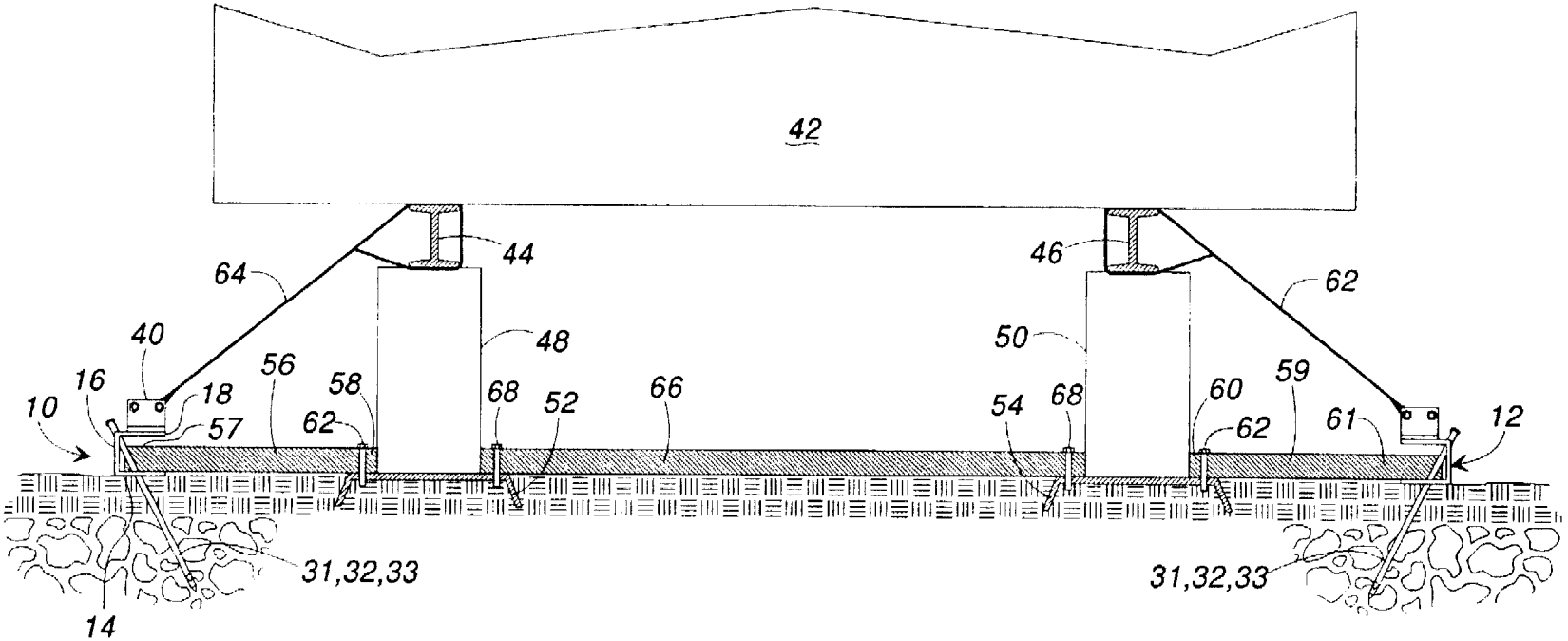
FIG. 3 is a side elevational view of two soil anchors of the present invention as used with a manufactured home foundation stabilizing system.

FIG. 3 is a view of drive anchors 10 utilized in a foundation stabilizing system. A manufactured home 42 is supported by a pair of parallel I-beams 44, 46 that are placed upon two rows of spaced piers (only one pair of piers 48, 50 is shown). The piers can be concrete blocks, metal or wooden posts, or other supporting devices. Preferably, the piers are supported by one or more stabilizer or cleated plates 52, 54.

A drive anchor 10 of the present invention is placed in the ground toward the outside of each pier. Rod support bracket 12 of a drive anchor 10 is placed so that the first arm 14 rests upon the ground. Rods 31, 32, and 33 are then driven into the ground through the sets of holes of the bracket. The rods slope downwardly beneath the manufactured home 42.

Compression members 56, 59 such as 2×4 wooden planks, are positioned so that one end 57, 61 rests inside the channel-shaped face of the support bracket of a drive anchor 10 and the other end 58, 60 rests upon a cleated plate 52 or 54. The end of the compression member on the cleated plate may be bolted by a U-bolt 62 to the cleated plate, as described in the above discussed patent applications. The end 57 or 61 of the compression members 56 and 59 fit inside the channel of the rod support bracket 12 between the arms 14, 18 of the bracket and against the middle drive rod 32, or against the connecting portion 16 of the bracket if only two rods are used. The end 57, 61 of the compression member also can be notched at 65 so as to straddle the middle rod 32 and extend between the drive rods 31, 33 of the anchor and bear against the connecting portion 16 of the bracket.

The foundation stabilizing system further includes straps 62 and 64 each having one end attached to the anchor 10 and the other end wrapped around the I-beam and fastened back onto the strap with a buckle (not shown). The anchor 10 includes connecting means for attaching the strap to the anchor. In the preferred embodiment the connecting means is a tensioning head 40 attached to the second arm 18 of the anchor with a slat formed in a carriage bolt 39 for receiving an end of the strap.

An important aspect and advantage of the drive anchor is that the anchor can be used in substantially all densities of soil. In places of loose or low density soil, it will be preferable to employ all three drive rods. In areas of high density soil and rock only the two outer rods need be used.

Another advantage of the drive anchor disclosed herein is that because of the arrangement of the sets of holes 20 and 26, 22 and 28, and 24 and 30 in the support bracket 12, which diverge from the longitudinal axes 31*a*, 32*a* and 33*a* rods 31–33 which is above the center of the bracket downwardly toward the ground, the installer must drive the first of the outer rods to be installed all the way into proper anchoring position before the second outer rod can be installed. In other words, the holes are arranged to orient the outer drive rods to intersect each other and the center rod above the second arm 18 of the rod support bracket 12 if both of the outer rods extend more than a predetermined distance above the bracket. The first installed rod must be driven past a predetermined distance before the second installed rod is installed so that the upper end of the rods do not interfere with the placement of the next rod to be driven. Thus, the anchor has a built-in safety feature that insures that the rods will be driven all the way into the ground. Further, in areas of low soil density, where the central rod is used, the central rod can be driven into the ground first, thus stabilizing the bracket 12 before the outer rods are driven in. Of course, as discussed above, the central rod does not need to be used in high or medium density soil or if there is rock present in the soil.

While the drive anchor 10 is described as utilized in a particular stabilizing foundation system, it should be understood that the anchor can be used in many other systems. Other elements can be added to the compression system, such as those disclosed in the above discussed patent applications of Applicant. For example, a central compression member 66 can be placed between and in abutment with the piers 48 and 50 and connected to the plates 52 and 54 with U-bolts 68. In addition, the drive anchors 10 can be used with a double wide manufactured home.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. A drive anchor for use in a manufactured home stabilizing foundation system which includes parallel rows of piers for supporting a manufactured home and a plurality of tensioning straps that are used to stabilize the manufactured home above ground, said drive anchor comprising:

an elongated C-shaped in cross section rod support bracket having a first arm for placement on a ground surface, a second arm for placement spaced above a ground surface, and a connecting web extending between said first and second arms;

at least two drive rods, each of said drive rods having a shaft portion to be driven into a ground surface;

said support bracket including means for receiving said shaft portion of each rod such that each rod is driven through each arm of said support bracket and into a ground surface beneath said support bracket with said rods diverging downwardly away from each other to hold said bracket against the ground surface; and means for attaching a tensioning strap of a manufactured home stabilizing foundation system to said drive anchor.

2. The drive anchor of claim 1, wherein said means for attaching a strap between said drive anchors and the manufactured home comprises a tensioning head fastened to said second arm of said bracket.

3. The drive anchor of claim 1, wherein said means for receiving said shaft portion of each drive rod includes at least two opposed sets of first and second holes in said bracket, wherein said first hole of each set is located in the first arm, and said second hole of each set is located at a juncture of said connecting web and said second arm, and wherein said second holes are placed inwardly on said bracket of said first holes, so that when one of said rods is driven through each of said sets of holes and driven into a ground surface beneath said support bracket a first driven rod must be driven to a predetermined depth through said support bracket to not interfere with the driving of a second driven rod through a second set of holes of said support bracket.

4. The drive anchor of claim 3, further including a third set of holes centrally located between said first and second sets for receiving and guiding placement of a third drive rod into the ground.

5. The drive anchor of claim 1, wherein said rod support bracket further includes means for accepting and retaining an end of a compression member placed between said anchor and a pier of a manufactured home stabilizing foundation system.

6. A stabilizing foundation system for supporting a manufactured home resting upon a pair of opposed I-beans supported by rows of opposed piers, said stabilizing foundation system comprising:

at least one cleated plate for positioning underneath each pier;

a drive anchor as recited in claim 1 driven into a ground surface outside of each pier;

a compression member placed between and abutting each drive anchor and a pier adjacent said drive anchor; and a tensioning strap attached between each said drive anchor and its adjacent I-beam.

7. The stabilizing foundation system of claim 6, wherein each of said compression members includes an end portion extending between said first and second arms of said rod support bracket and against said connecting portion of said rod support bracket, each of said compression members extending between said drive rods of its respective anchor.

8. A drive anchor for use in a stabilizing foundation system for a manufactured home which includes a pair of opposed parallel I-beams supported by rows of opposed piers and at least one tensioning strap, wherein the manufactured home is to be stabilized above ground comprising rock, said drive anchor comprising:

a first drive rod and a second drive rod;

a rod support bracket for placement on a ground surface, said support bracket having first and second arms and including holes provided through each of said arms, said holes being arranged to receive and guide each of said drive rods through each of said arms of said support bracket such that said drive rods are driven at attitudes which diverge downwardly and outwardly from each other as said rods pass through said arms of said bracket and into a ground surface beneath said rod support bracket; and a tensioning head mounted on said bracket constructed and arranged for attachment of a tensioning strap extending between said tensioning head and the manufactured home.

9. The drive anchor of claim 8, wherein said holes of said support bracket are oriented such that said drive rods will intersect each other above said rod support bracket if both of said rods protrude more than a predetermined distance above said support bracket.

10. The drive anchor of claim 8, wherein said rod support bracket comprises an elongated C-shaped plate having an intermediate connecting section that connects to each of said arms, said holes being arranged in sets with a first hole of each set being in said first arm and a second hole of each set being at a juncture of said second arm and said connecting section, and wherein said first holes are placed nearer an outer edge of the bracket than said second holes, thus causing a first rod inserted through one set of holes to diverge outwardly from a second rod inserted through the other set of holes.

11. The drive anchor of claim 10, wherein when said second rod is installed after said first rod is installed, said second rod cannot be installed unless said first rod has been driven into the ground past a predetermined point.

12. The drive anchor of claim 8, wherein said drive rod includes an enlarged portion at one end thereof that prevents said end of said rod from being inserted through a hole in said bracket.

* * * * *